US008025170B1

(12) United States Patent
Richard

(10) Patent No.: US 8,025,170 B1
(45) Date of Patent: Sep. 27, 2011

(54) CAN CAP COVERING

(76) Inventor: Gary P. Richard, Gloucester, MA (US)

( * ) Notice: Subject to any disclaimer, the term of this patent is extended or adjusted under 35 U.S.C. 154(b) by 794 days.

(21) Appl. No.: 11/804,797

(22) Filed: May 21, 2007

Related U.S. Application Data

(60) Provisional application No. 60/802,369, filed on May 22, 2006.

(51) Int. Cl.
*B65D 43/18* (2006.01)
*B65D 17/34* (2006.01)

(52) U.S. Cl. ..... 220/254.4; 220/269; 220/906; 220/821; 220/719

(58) Field of Classification Search ..... 220/269, 220/906, 254.4, 719, 820, 821
See application file for complete search history.

(56) References Cited

U.S. PATENT DOCUMENTS 4,660,446 A * 4/1987 Soltis ..... 81/3.55
5,509,380 A * 4/1996 Tipp ..... 81/3.55
5,799,815 A * 9/1998 Lang ..... 220/258.5
5,911,794 A * 6/1999 Nordhoff ..... 81/3.55
6,082,030 A * 7/2000 Kesselring et al. ..... 40/307
6,098,830 A * 8/2000 Jamieson ..... 220/259.1
6,460,719 B1 * 10/2002 Finmark ..... 220/258.5
7,089,825 B2 * 8/2006 Klosterman ..... 81/3.55
7,516,866 B2 * 4/2009 Brook et al. ..... 220/254.1
2005/0284263 A1 * 12/2005 Klosterman ..... 81/3.55
2007/0051725 A1 * 3/2007 Glade ..... 220/254.4

* cited by examiner

*Primary Examiner* — Anthony Stashick
*Assistant Examiner* — James N Smalley
(74) *Attorney, Agent, or Firm* — David Prashker, Esq.

(57) ABSTRACT

The present invention is a cap covering for a punch-key tab rotably attached to the top of a preformed can, wherein the punch-key tab is to be utilized by a person to punch out a prepared flap seal in the can top along a predefined scored boundary. The cap covering includes an attachable and detachable hollow casing which can be fitted on-demand onto the handle of a punch-key tab.

The invention will distinguish individual ownership among identical cans of beverage; will serve as a closure to aid in keeping the carbonation (if any) in the beverage; will aid in maintaining the beverage at the desired drinking temperature; and will act in minimizing spillage, keep bugs and debris out, and in keeping the beverage in an unadulterated state.

7 Claims, 7 Drawing Sheets

CAN CAP COVERING

PRIORITY CLAIM

The present invention was first filed on May 22, 2006 as U.S. Provisional Patent Application Ser. No. 60/802,369. The priority and legal benefit of this first filing is expressly claimed herein.

BACKGROUND OF THE INVENTION

The metallic can of the punch-key tab type has long been the industry favorite for use as a beverage container. Carbonated drinks, beer, fruit juices, vegetable juices, diet supplements, energy drinks, children's formula, and even water are commonly packaged in such can containers for sale to the consuming public. Statistically, there are over 120 billion beverage cans produced every year just by the three largest manufacturers; that is, over 328 million cans are produced every day.

Metallic can containers are an efficient, low cost method of marketing consumer beverages. Cans are easy to transport, stack and store for relatively long periods of time. After consumption of the beverage, the metal container (which is primarily, but not exclusively, formed of aluminum or aluminum alloys), can be recycled and used again. Thus, the popularity of certain beverage containers, such as soft drink cans, has grown enormously in recent years; and it is commonplace now to see individuals consuming beverages from such containers anytime during their life activities.

When ready to be opened, most can containers have a discrete metallic punch-key tab (also known as either a pop-top tab, or pop-open tab, or pull-top tab) that when used will breech the metallic can top to create a prepared aperture which allows humans to access and consume the beverage. When opened, the can will stand upright well and efficiently, because of the can's bottom shape and diameter.

The Nature of the Long Recognized Problems

Once a metallic can has been opened, there has not been any effective way to re-seal, preserve and store unused portions of the liquid product inside the can. The period of time that a person will take to consume a beverage will vary, depending on the volume of the container and the person's desire or need to finish all of the beverage. The period of time for complete consumption is also affected by other factors such as the loss of carbonation over time, an increase or loss of temperature, the absence or presence of preservatives, etc.

Consumers know that there is a limited time for drinking the beverage, after which the beverage remaining in the can will no longer be suitable for consumption. Even refrigeration cannot overcome deterioration of the beverage once the can has been opened because the can opening cannot be re-closed. Consequently, the consumer often decides to consume more of the beverage, or more quickly, than he actually wants at the time; or more often, decides to dispose of the unwanted portion of the beverage still remaining in the can.

In addition to the foregoing, certain inconveniences and health hazards are generally associated with the use of punch-key tab cans and containers, which to date have defied solution from the standpoints of design, cost and/or convenience. The can design most favored and commonly used today employs a discrete punch-key tab which is usually rotably secured to the can's top surface via a center rivet or pivotal pin; which generally lies parallel to the can's top surface prior to use; and which can be pivoted by hand over the center rivet or pivotal pin to punch out a prepared flap seal in the can top along a predefined scored boundary.

However, few if any of the presently used punch-key tab can designs offer or provide a protective cover, lid, or other form of closure which would protect the beverage from possible contamination, and aid in keeping its carbonation, temperature, and freshness, after the can has been opened. In fact, the conventional type of beverage container having an attached punch-key tab suffers from at least five different and distinct disadvantages:

First, most people simply use the punch-key tab to open a beverage can and then directly drink from the top of the can. This common practice ignores the fact that the exterior surface of the can, including the region of the opening where the lips must be placed for drinking the beverage, is rarely sanitary. Thus, although the exterior surfaces of the can container may have been reasonably clean when leaving the factory assembly line, it is typical that dust, dirt, rodent contaminants, bacteria and/or viruses can and often do congregate and contaminate the drinking area around the pull-tab by the time the consumer opens the can.

Second, the conventionally known and used punch-key tab can structure lacks a resealing mechanism; and thus the prepared flap seal (present in the top of the can along a predefined scored boundary) cannot be closed after it has been opened. The open beverage can often attracts a variety of insects, particularly bees, which seek out the sugar-sweetened soft drink or the like; and other airborne contaminates from wind-blow dust and dirt commonly accumulate onto the exterior surfaces of the can, particularly when such drinks are consumed outdoors. Thus when beverages are consumed while on the patio, or on a trip, or at the beach, there is a significant risk that bees or other flying insects may enter the interior of the beverage container. Consequently, if this is not noticed by the person drinking the beverage, the bee or other insect can be inadvertently contacted, or even be swallowed, resulting in stings of the mouth and/or throat.

Third, in many environments (such as factories, hospitals, airplanes, laboratories and the like) dust particles, germs and other potentially hazardous debris may enter an open beverage container without the knowledge of the consumer. Given the increasing spread of viruses and other disease-causing agents coupled with the diversity of means by which such contaminants may be carried, it is very desirable to minimize the exposure of the beverage in an open can to such contaminants. People have resorted to wearing masks to protect themselves from airborne viruses like the bird flu, yet they have no practical way of sealing off their open beverage can from such threats.

Fourth, there is an ever increasing awareness of the potential health hazards associated with the mistaken use by one person of another's beverage can. This situation can easily occur during social occasions such as parties, family reunions, community meetings and the like, during which confusion arises as to which can container is being used by a particular person, and whereby one individual may mistakenly drink from the can of another. It is very desirable to eliminate such mistakes in usage to the fullest extent possible, owing to the increasing prevalence of a person disposing of his cigarette butts or other trash into another's beverage can, or the spreading of pathogenic bacteria and viruses via the inadvertent and unfortunate exchange of human saliva caused by drinking from another person's can. These social settings, as well as those in drinking establishments, can also have serious violations from individuals who purposely place drugs or other matter into an unsuspecting individual's non-closable beverage can.

Fifth, in many instances involving metallic cans, the punch key (used to separate the flap opening from the can top along a predefined scored boundary) is usually secured by a center rivet or pivot pin and lies parallel to the can's top surface. In order for any person to lift the punch key, which is a fairly thin and sharp piece of metal, he must use a fingertip to hook onto the punch key's underside and pull it upwardly. This lift maneuver is particularly difficult for persons who have long, or very short, fingernails. Also, using one's fingertip to lift the key to open a beverage can is often an unpleasant experience, albeit not typically a painful one.

Past Efforts to Solve These Problems

For the reasons given above, a number of diverse efforts and attempts have been made in the past to provide protective shields and other types of covers for metallic cans and similarly designed containers. The range and variety of these past efforts are merely represented and exemplified by the following: U.S. Pat. No. 6,290,084 which offers a rotary protective cover attachment for a beverage container; U.S. Pat. No. 6,158,608 which provides a sealing tab on the can's surface that can be used to reseal the can after it has been opened; U.S. Pat. No. 6,032,816 which discloses a cap for closing a container having a breakable seal; U.S. Pat. No. 6,015,059 which provides a pull top type of can with a seal; U.S. Pat. No. 5,813,559 which describes a sanitary cover for a beverage can; U.S. Pat. No. 5,351,853 which presents a modular closure for selectively sealing an opening in a pry-tab beverage can; U.S. Pat. No. 5,285,924 which provides a slidable beverage container cover; U.S. Pat. No. 5,269,432 which discloses an insect-proof and tamper-evident cover for a beverage container; U.S. Pat. No. 5,199,591 which reveals a re-sealable flip-top beverage can having a rotable sealing top mounted above the can; U.S. Pat. No. 4,852,763 which offers a removable and reusable protective cover for a beverage container; and U.S. Pat. No. 4,717,039 which provides a reclosing apparatus for an open container to inhibit spillage. The Specification text and Drawing of all these issued U.S. patents are individually expressly incorporated by reference herein.

In addition, a number of other developments relating to improvements in overlay covers or seals for cans have also occurred. Among these innovations are the following: U.S. Pat. No. 5,934,497 which discloses a sanitary beverage can lid; U.S. Pat. No. 5,934,495 which describes a protective film for cans and for drink and food containers in general; U.S. Pat. No. 5,647,497 which reveals a variety of protective removable covers for use with beverage containers; U.S. Pat. No. 5,292,022 which describes a closure for metal beverage containers; U.S. Pat. No. 5,108,003 which describes a non-swivel cover which extends over the top of a beverage can; U.S. Pat. No. 4,927,048 which discloses a cover formed of a thin aluminum sheet which closely adheres to the contours of the can top; U.S. Pat. No. 4,895,270 which presents describes a thin latex cover which is applied over the upper end of a can to protect that portion of the can; U.S. Pat. No. 4,708,257 which offers a flat, thin sheet of plastic film which is adhesively attached to the rim of a can to seal the upper surface thereof; U.S. Pat. No. 4,609,123 which provides a sanitary re-closable lid for a beverage can; and U.S. Pat. No. 4,162,023 which describes a sanitary cover which secures about the crimped upper edge of a can. The Specification text and Drawing of all these issued U.S. patents are also individually expressly incorporated by reference herein.

The Current Situation

Nevertheless, most of these developments and innovations suffer from design difficulties and manufacturing drawbacks of one kind or another. For example, most of these devices are not provided by the manufacturer of the can, but exist as optional add-on items to be purchased separately by the consumer of the beverage. However, most people find it to be very inconvenient to carry a beverage can cover or similar device on their person wherever they go.

Similarly for cost reasons, most can manufacturers do not wish either to modify or to replace the presently existing punch-key tab can design for the beverage can top because it is not economically feasible for them to make a major design change and alteration to the can manufacturing process and product now highly favored by the consuming public and commonly in use. There is also an underlying fear for the manufacturer that the public consumer might actually dislike any newly redesigned can top and thus refuse to buy any beverage which is sold in any can or container having that newly redesigned top—a devastating result and outcome for any can manufacturer.

For all of these reasons, there remains a continuing need for a better designed, more convenient, and functionally improved beverage can closure.

SUMMARY OF THE INVENTION

The present invention provides a cap covering for a punch-key tab rotably attached to the top of a preformed can, wherein the punch-key tab is to be utilized by a person to punch out a prepared flap seal in the can top along a predefined scored boundary, said cap covering comprising:

an attachable and detachable hollow casing which can be fitted on-demand onto the handle of a punch-key tab then rotably attached to the top of a preformed can, said hollow casing having at least one solid wall of fixed dimensions and configuration, a shaped opening sized to accommodate entry and passage of the handle of a punch-key tab, and an internal cavity of pre-set spatial volume sized to accept the handle of a punch-key tab.

BRIEF DESCRIPTION OF THE FIGURES

The present invention may be more easily understood and better appreciated when taken in conjunction with the accompanying Drawing in which.

Prior Art FIGS. 1A-1C respectively are schematic views of three different styles of conventionally known and used punch-key tabs, each of which is rotably attached to the top of a preformed can.

DETAILED DESCRIPTION OF THE INVENTION

The present invention is an unique cap covering for a punch-key tab which is then rotably attached to the top of a preformed metallic can, wherein the punch-key tab is utilized by a person to punch out a prepared flap seal in the can top along a predefined scored boundary. The cap covering comprises an attachable and detachable hollow casing which can be fitted on-demand onto the handle of a punch-key tab.

The invention will allow the user to distinguish individual ownership among identical cans of beverage, through the usage of different colors and designs, etc; to keep the carbonation (if any) in the beverage as well as maintain the beverage closer to the desired drinking temperature; and to minimize accidental spillage, keep bugs and debris out, and hold the beverage in an unadulterated state.

I. Conventionally Known and Used Punch-Key Tab Structures

The can designs most favored by the consuming public and commonly used by can manufacturers today employ a discrete punch-key tab which is usually rotatably secured to the can's top surface via a center rivet or pivotal pin; which generally lies parallel to the can's top surface prior to use; and which can be pivoted by hand over the center rivet or pin to punch out a prepared flap seal in the can top along a predefined scored boundary. A representative array of three different punch-key tab structures frequently used with beverage cans is illustrated by Prior Art FIGS. 1A, 1B, and 1C respectively.

Figure 1A:
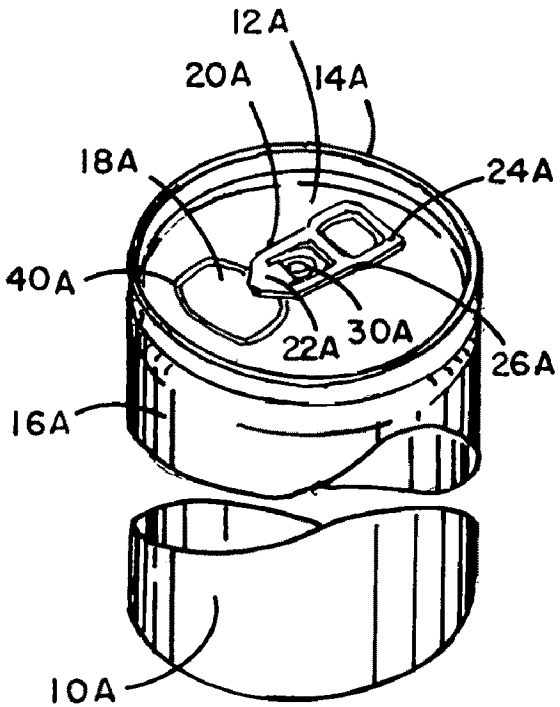
PRIOR ART FIG. 1A
Figure 1B:
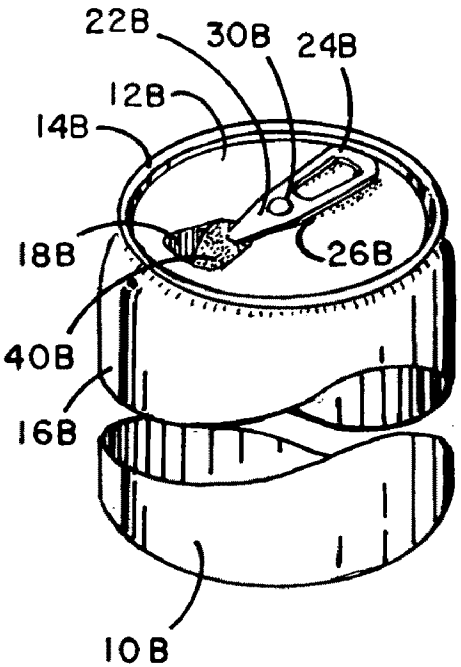
PRIOR ART FIG. 1B
Figure 1C:
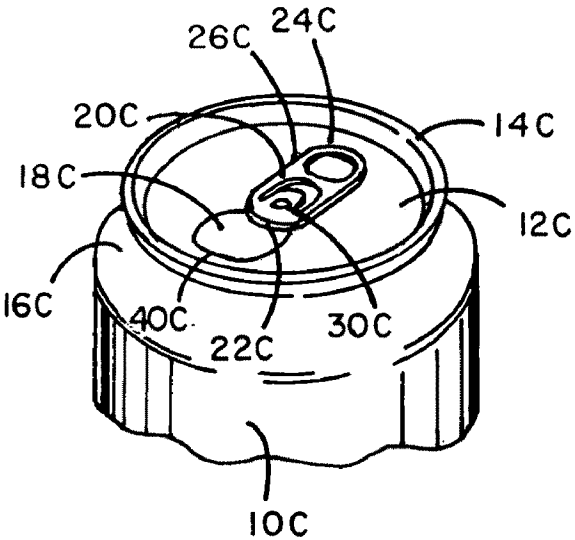
PRIOR ART FIG. 1C

As seen therein, FIG. 1A illustrates a square-like tab format; FIG. 1B reveals a elongated tab structure; and FIG. 1C shows a rounded or ovoid tab style. Nevertheless, despite the individual differences in dimensions, general configuration, and overall appearance for these different tab constructions, each of the punch-key tab structures commonly share the same essential structural features and functions.

Accordingly, each can container 10*a*, 10*b*, 10*c* comprises an individual can top surface 12*a*, 12*b*, 12*c*; an individual circular rim edge 14*a*, 14*b*, and 14*c*; and a cylindrically shaped can body 16*a*, 16*b*, 16*c*. Also, as an integral part of each individual can top surface 12*a*, 12*b*, 12*c* is a discrete flap seal 18*a*, 18*b*, 18*c* having a predefined scored boundary 40*a*, 40*b*, 40*c*. Each individual flap seal 18*a*, 18*b*, 18*c* is a piece of shaped metal or metallic alloy which is hinged or attached at one side to the can top surface 12*a*, 12*b*, 12*c*; and is used to cover a prepared gap opening which serves as an access to the liquid or beverage then housed and contained within the cylindrical can body 16*a*, 16*b*, 16*c*.

Furthermore, each can container shown by Prior Art FIG. 1 as a whole has an individual punch-key tab 20*a*, 20*b*, 20*c* which is rotably secured to the can top surface 12*a*, 12*b*, 12*c* via an individual center rivet or pivotal pin 30*a*, 30*b*, 30*c*. Each tab 20*a*, 20*b*, 20*c* generally lies parallel to the can top surface prior to use; and is a tool which can be pivoted by the human hand over the securing center rivet or pivotal pin 30*a*, 30*b*, 30*c*; and be used to punch out an individually prepared flap seal 18*a*, 18*b*, 18*c* in the can top surface 12*a*, 12*b*, 12*c* along an individual predefined scored boundary 40*a*, 40*b*, 40*c*.

The overall structure of each individual punch-key tab is also striking similar and commonly shared among the formats of FIGS. 1A, 1B, 1C. Each individual punch-key tab 20*a*, 20*b*, 20*c* comprises a front punching tool 22*a*, 22*b*, 22*c*; a rear key handle 24*a*, 24*b*, 24*c*; and a central tab body section 26*a*, 26*b*, 26*c*. Within each individual central tab body section 26*a*, 26*b*, 26*c* is a securing rivet or pivotal pin 30*a*, 30*b*, 30*c* which rotably joins and pivotably fastens each punch-key tab to its individual can top surface.

II. Embodiments of the Present Invention

The present invention is can cap covering which can be manufactured in a wide range of differently designed styles, exist in a diverse variety of alternative sizes and overall shapes, and be composed of a broad assortment of differently formulated elastomeric and non-elastomeric substances. Accordingly, a large number of different embodiments can be easily manufactured; and it is expected that the particular style and format will be chosen to meet the needs of the manufacturer or the personal preferences of the purchasing public.

Regardless of the specific style, size and shape, and composition of the can cap covering, the article of manufacture will always be an attachable and detachable hollow casing which can be fitted on-demand onto the handle of a punch-key tab then rotably attached to the top of a preformed can. This hollow casing will comprise and always present the following structural features: at least one solid wall of fixed dimensions and configuration; a shaped opening in the solid wall which is sized to accommodate entry and passage of the handle of a punch-key tab; and an internal cavity of preset spatial volume and configuration which will accommodate and accept the handle of a punch-key tab.

Merely to evidence and demonstrate the broad range and variety of useful embodiments, two preferred formats and constructs are described in detail hereinafter. It will be expressly understood, however, that the two preferred embodiments disclosed below merely represent and exemplify the true number of choices which are available for manufacture and use.

A First Preferred Embodiment

Figure 2A:
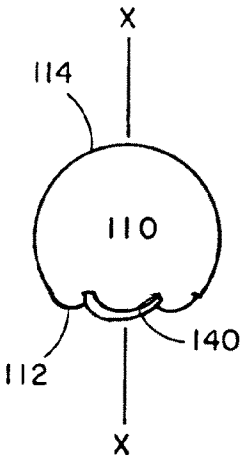
FIGS. 2A-2E respectively are different schematic views of a first preferred embodiment of the present invention.
Figure 2B:
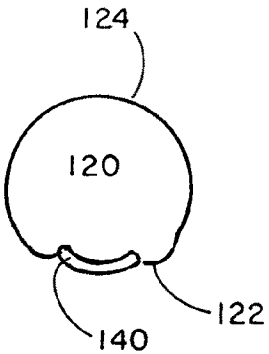
Figure 2C:
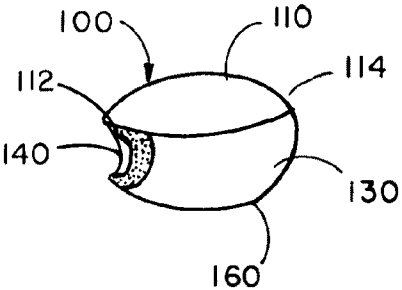
Figure 2D:
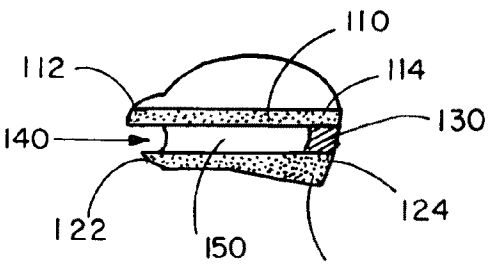
Figure 2E:
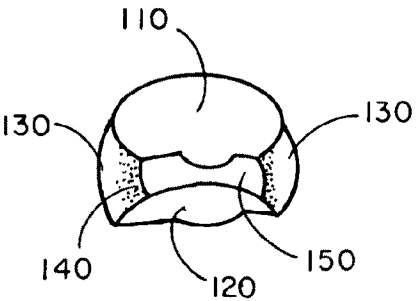

One preferred embodiment of the can cap covering which comprises the present invention is illustrated by FIGS. 2A-2E respectively. As shown therein, FIG. 2A is an overhead view of the top wall of the cap covering; FIG. 2B is an overhead view of the bottom wall of the cap covering; FIG. 2C is a side view of the cap covering; FIG. 2D is a cross-sectional view of the cap covering taken along the axis XX' of FIG. 2A; and FIG. 2E is a frontal view of the cap covering. FIG. 2 as a whole thus illustrates the unique structural construction and particular features of this first preferred embodiment.

Thus as seen in FIGS. 2A-2E, this preferred embodiment comprises a cap covering 100 which can be fitted on-demand onto the handle of a punch-key tab then rotably attached to the top of a preformed can (as shown by Prior Art FIGS. 1A-1C respectively). The cap covering 100 comprises an oval-shaped solid top wall 110 having predetermined dimensions and thickness, an oval-shaped solid bottom wall 120 of preset dimensions and thickness, and an oval sidewall 130 of prechosen dimensions and thickness. The top wall 110, the bottom wall 120, and the side wall 130 are integrally joined together as a unified article of manufacture, and thereby collectively form a substantially disc-shaped hollow casing 160.

As shown by FIGS. 2C, 2D, and 2E, there is a substantially rectangularly-shaped opening 140 in the solid sidewall 130 which serves as a point of entry for and access to an internal cavity 150 having a preset spatial volume and configuration. The rectangularly-shaped opening 140 of the hollow casing 160 is sized to accommodate the handle portion of a punch-key tab, and to permit the entry and passage of the handle portion of the punch-key tab into the spatial interior of the disc-shaped hollow casing 160. Similarly, the internal cavity 150 of the hollow casing 160 is sized and sized and dimensioned to provide a preset spatial volume which will accept and hold the handle portion of a punch-key tab.

It will be noted and appreciated that in this first preferred embodiment the top solid wall 110 and the bottom solid wall are not identical in their overall dimensions. This is best illustrated by FIG. 2D. As shown therein, the top solid wall 110 is a planar sheet of solid matter having a minimal thickness which is substantially uniform over its entire oval-shaped diameter from its forward edge 112 to its rearward edge 114. In comparison, the bottom solid wall 120 is a thicker beveled sheet of solid matter having an overall thickness which is graduated over its oval-shaped diameter and is an incline which increases markedly from its forward edge 122 to its rearward edge 124.

A Second Preferred Embodiment

Figure 3C:
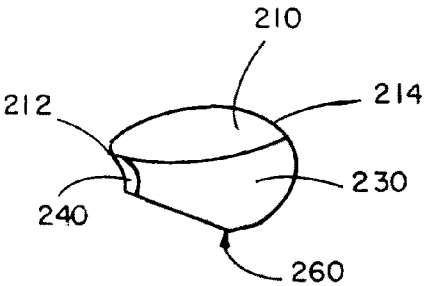
FIGS. 3A-3E respectively are different schematic views of a second preferred embodiment of the present invention.
Figure 3B:
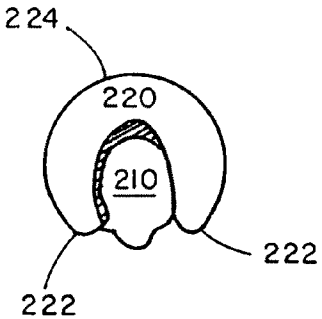
Figure 3A:
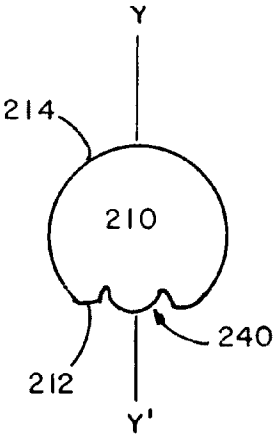
Figure 3E:
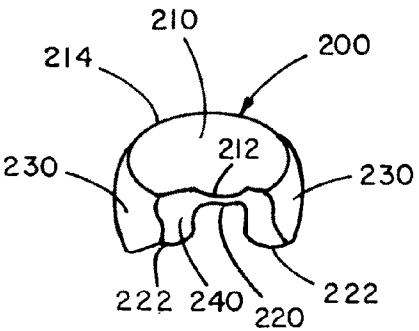
Figure 3D:
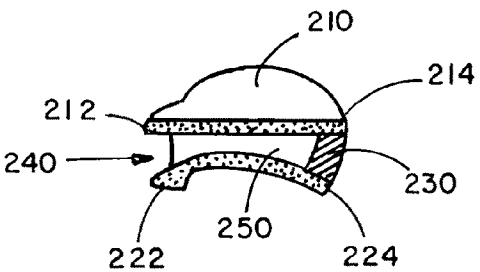

A second preferred embodiment of the can cap covering comprising the present invention is illustrated by FIGS. 3A-3E respectively. As shown therein, FIG. 3A is an overhead view of the top wall of the cap covering; FIG. 3B is an overhead view of the bottom wall of the cap covering; FIG. 3C is a side view of the cap covering; FIG. 3D is a cross-sectional view of the cap covering taken along the axis YY' of FIG. 3A; and FIG. 3E is a frontal view of the cap covering. FIG. 3 as a whole thus illustrates the unique structural construction and particular features of this second preferred embodiment.

Thus as seen in FIGS. 3A-3E, this second preferred embodiment comprises a cap covering 200 which can be fitted on-demand onto the handle of a punch-key tab then rotably attached to the top of a preformed can (as shown by Prior Art FIGS. 1A-1C respectively). The cap covering 200 comprises an oval-shaped solid top wall 210 having predetermined dimensions and thickness; a horse-shoe shaped bottom wall 220 of preset dimensions and thickness; and an oval sidewall 230 of prechosen dimensions and thickness. The oval-shaped top solid wall 210, the horse-shoe shaped bottom wall 220, and the solid side wall 230 are integrally joined together as a unified article of manufacture, and thereby collectively form a substantially disc-shaped hollow casing 260.

As shown by FIGS. 3C, 3D, and 3E respectively, there is a substantially rectangularly-shaped opening 240 in the solid sidewall 230. The rectangularly-shaped opening 240 serves as a point of entry for and access to an internal cavity 250 having a preset spatial volume. The rectangularly-shaped opening 240 of the hollow casing 260 is sized to accommodate the handle portion of a punch-key tab, and is employed as a point of entry into and passage for the handle portion of the punch-key tab into the spatial interior of the disc-shaped hollow casing 260. In a similar fashion, the internal cavity 250 of the hollow casing 260 provides a preset spatial volume which is purposely sized and properly dimensioned to accept and retain the handle portion of a punch-key tab.

It will be again noted and appreciated that, in this second preferred embodiment, the oval-shaped top wall 210 and the horse-shoe shaped bottom wall are not identical in their overall dimensions. This is best illustrated by FIG. 3D. As seen therein, the oval-shaped top solid wall 210 is a planar sheet of solid matter having a minimal thickness which is substantially uniform over its entire oval-shaped diameter from its forward edge 212 to its rearward edge 214. In comparison, the bottom wall 220 is not only partially open and appears in a substantially horse-shoe shaped configuration, but also is a thicker beveled sheet of matter having an overall thickness which is graduated over its horse-shoe shaped form and increases in slope markedly from its forward edges 222 to its rearward edge 224.

Variable Parameters and Optional Features

The cap covering of the present invention can be prepared in multiple formats and styles. Some of the variable parameters for and optional features of the cap covering are described in detail below.

Materials for Making the Cap Covering

The cap covering comprising the present invention is preferably a flexible and resilient article of manufacture formed using any conventionally known elastomeric substance or combination of different elastomeric compositions. By definition, elastomers are long polymer chains which exist above their glass transition temperature. Elastomers are usually lightly crosslinked and are easily deformed. Commonly used elastomers include polybutadiene (used in shoe soles), polyisobutylene (used in automobile tires) and polyisoprene (natural rubber). For purposes of practicing the present invention, any conventionally known or commercially available elastomeric composition may be employed alone or in combination with other elastomeric substances.

Elastomeric polymer chains can be crosslinked, or connected by covalent bonds. Crosslinking makes elastomers reversibly stretchable for small deformations. Thus, when stretched, the polymer chains become elongated and ordered along the deformation direction; but this condition is entropically unfavorable. Accordingly, when no longer stretched, the chains randomize again; and the crosslinks guide the elastomer back to its original shape. It is for these properties that elastomeric materials are most preferred for the manufacture of the present invention.

In the alternative, however, the cap covering may optionally be prepared as a rigid, non-pliable article using any commonly available non-elastomeric formulation or a mixture of different non-elastomeric compounds. A variety of different synthetic rubbers and non-deformable plastics are commercially available and sold which can be usefully employed to make the cap covering. For purposes of practicing the present invention, any conventionally known or commercially available non-elastomeric composition may be employed alone or in combination with other substances.

Manufacture

The cap covering may be manufactured using any conventionally known process or method. Thus, molding and/or thermal extrusion are the preferred techniques; while casting, stamping, and the individual assembly of parts are the least desirable. For purposes of practicing the present invention, any conventionally known mode or commercially suitable manner of manufacture may be employed to produce the cap covering.

Engineering Specifications

In general, the cap covering should correspond and be limited in its overall size dimensions such that it can be easily placed into the small amount of space existing around and between the punch-like tab and the top surface of the can. It must always be remembered that the cap covering must be fitted onto the handle of a punch-key tab then rotably attached to the top of a preformed can; that the tab handle and its fitted cap covering are together to be rotated 180 degrees around the center rivet or pivot pin until both the tab handle and its fitted cap covering come to rest over the opening in the top of the beverage can; and that the cap covering must be attachable to and detachable from the handle of a punch-key tab at any time on-demand.

For these reasons, a preferred and optimal set of size dimensions for the cap covering follows. It is presumed first that the punch-key tab dimensions are approximately 15 cm×25 cm and that the second preferred embodiment described in detail above is to be utilized as the cap covering. In this situation, an optimal set of dimensions are: the top solid wall is about 25 cm×30 cm in size; the horse-shoe shaped bottom wall is about 30 cm×35 cm while the open area in the second wall is about 10 cm×20 cm; and the internal spatial cavity is about 15 cm×24 cm×0.5 cm in volume.

Overall Three-Dimensional Appearance

The cap covering comprising the present invention is a three-dimensional article of manufacture which can be prepared in any reasonable size, in every possible configuration, and in any design or style. Thus, the overall appearance and general profile of the hollow casing may be either regular or irregular in design; be either symmetrical or asymmetrical in shape; and be either geometric or non-geometric in form.

As merely one example, if a regular, symmetric and geometric construct format is desired for the hollow casing, any of the following overall perimeter outlines and contoured patterns may be employed: a circle format; an ellipse; a square configuration; a rectangular format; a hexagon shape; a frustum; a pentagon; and a protractor. Alternatively, any irregular pattern, all asymmetrical forms, and every non-geometric shape may be optionally used as the overall outline and profile for the cap covering.

Coloration and Luminescence

It is intended and expected that the manufacture of the cap covering will be made using materials which provide a range of different colors for the hollow casing. Any commercially available dye formulation which is chemically inert and biologically compatible with the material substance(s) used to make hollow casing can be used to provide every possible color, shade, hue, and brightness for the cap covering. Moreover, it is expected and intended that differently colored cap covering will be commercially sold in sets of 6-12 or more in order that each person in a group may have his own separate and identifiable colored cap covering for use.

Similarly, it is recognized that photoluminescent cap coverings would also be of particular value and use to the public purchaser. Accordingly, any of the conventionally available photoluminescent pigment compositions may optionally be admixed with the material substance(s) used to make hollow casing, with the result that the cap covering would glow in the dark. Merely exemplifying such photoluminescent pigment compositions are the following: Strontium Aluminate, Europium Doped Zinc Sulfide, Silicic Acid, Magnesium Strontium Salt, and Europium Doped Dysprosium.

Decorative Aspects

Clearly, because the cap covering may be prepared in any reasonable dimensions appropriate to and in scale with its intended site of application and use (i.e., fitted onto the handle of a punch-key tab), the hollow casing may be alternatively prepared and take tangible form in any decorative design, aesthetic format or artistic style the human mind can imagine.

The decorative aspects are envisioned to be possible in two different structural formats: In the first format, the hollow casing as a whole can be manufactured (using any conventionally known process such as molding) to present the desired decorative appearance; and the entire hollow casing structurally presents and exists in the decorative design or style. Thus, the hollow casing may appear to the human eye as a miniaturized version of the following: a balloon, a hot dog or sausage, a watch face or clock, a style of house, a replica of an automobile or truck, a doll, any article of clothing, a replica of a type of boat or ship, any hand or power tool, any type of sports equipment such as soccer balls and baseballs, and the like.

In the second structural format, the hollowing casing is prepared in essentially planar dimensions, such as those illustrated by FIGS. 2 and 3 respectively. In these preferred embodiments, the top solid wall provides a planar exterior surface for the subsequent attachment of a separately created and independently existing decoration or ornamentation. Thus, when complete with the intended decoration, the hollow casing can bear and exhibit on its top surface any of the following: any seal, insignia, or badge; all forms of writing, engraving or decorative pattern; any distinguishing symbol, logo, or trademark; all types of business names and distinguishing business trade dress; miniature symbols of one's profession, faith, patriotism, or creed; and any other three-dimensional form of artistic expression which is symbolic of or identified with a particular aspect of human life.

III. Manner of Intended Use

The cap covering of the present invention is suitable for use with any type or design of punch-key tab which is then rotably attached to the top of a preformed metallic can, and wherein the punch-key tab is to be utilized by a person to punch out a prepared flap seal in the metallic can top along a predefined scored boundary.

Installation

Figure 4:
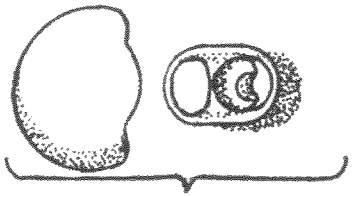
FIG. 4 is a photographic image showing the second preferred embodiment of the present invention in the act of being fitted onto the handle of a punch-key tab.
Figure 5:
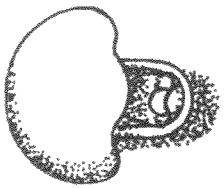
FIG. 5 is a photographic image showing the second preferred embodiment of the present invention after being fitted onto the handle of a punch-key tab.

The cap covering provides an attachable and detachable hollow casing which can be fitted on-demand onto the handle of a punch-key tab of a preformed can, either before or after the can is opened. This manipulation and event is illustrated by FIGS. 4 and 5 respectively.

Figure 6:
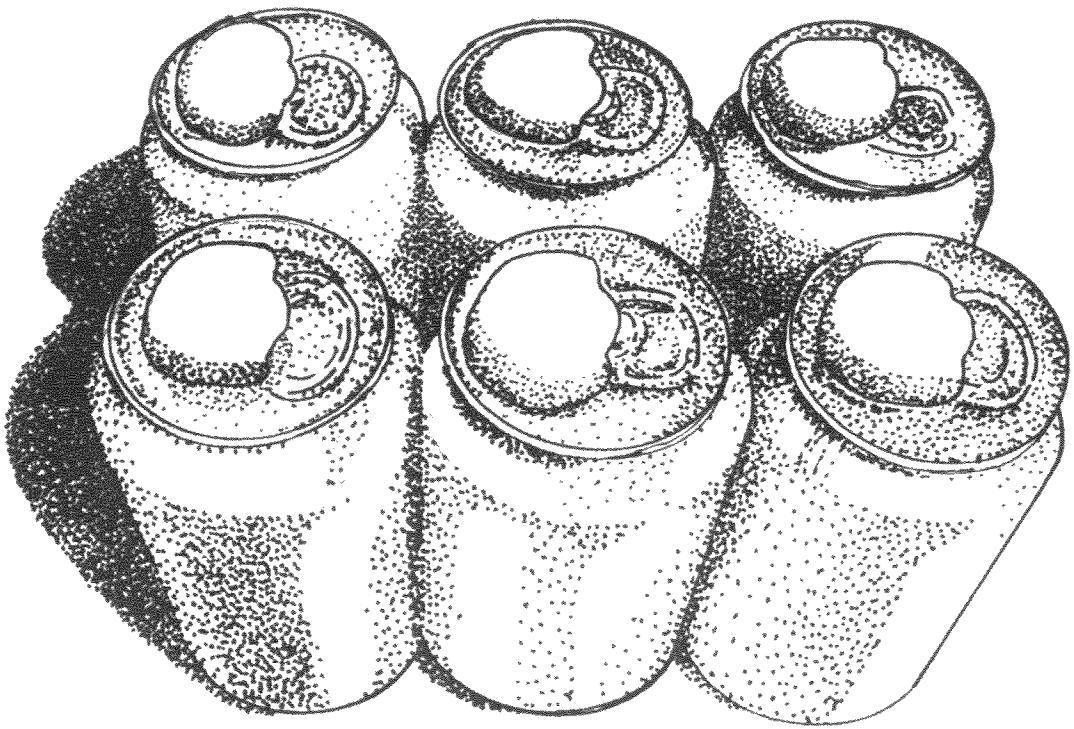
FIG. 6 is a photographic image showing six beverage cans after the second preferred embodiment of the present invention has been individually fitted onto the handle of each punch-key tab.

The cap covering can be pre-installed on a beverage can before shipment; or purchased as an after-market product. An illustration of multiple cap coverings installed upon the handles of punch-key tabs prior to the beverage cans being opened is shown by FIG. 6. As seen therein, six beverage cans have differently colored, individual cap coverings fitted onto each of their respective punch-key tabs before any of the cans have been opened. These cap coverings can remain seated over the handles of their respective punch-key tabs indefinitely, without fear of their becoming inadvertently disturbed or unintentionally detached.

An Aid when Opening the can

The cap covering may be employed as an aid when the person wishes to open the beverage can. The cap covering will protect the person's fingers from lacerations or pain occurring when the fingers are used to apply sufficient pivot pressure on the handle of the punch-key tab to breech or punch out the prepared flap seal in the can top along a predefined scored boundary.

Figure 7:
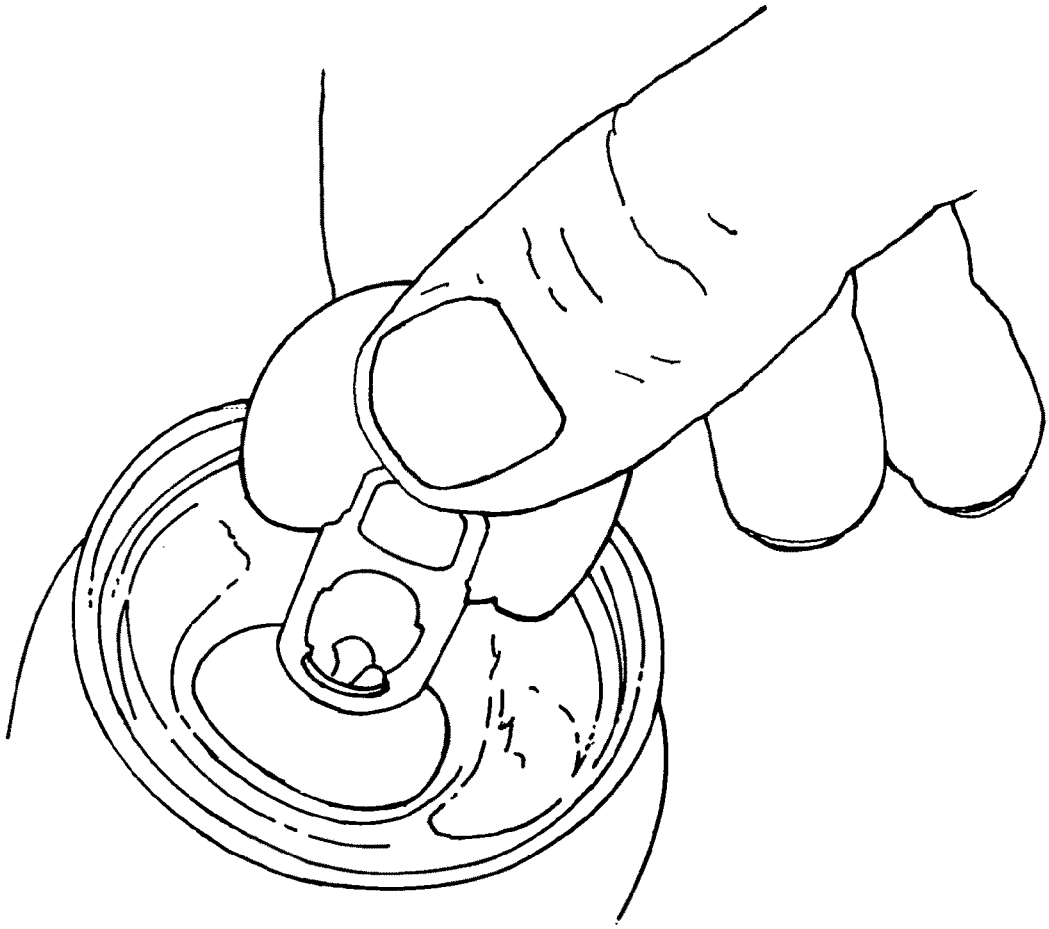
FIG. 7 is a photographic image showing the second preferred embodiment of the present invention after it has been inverted and placed for use as an aid to opening the beverage can.

When the cap covering is to be used as such an aid, the cap covering is removed from the handle of the punch-key tab; is turned upside down; and is slid under the tab handle into the limited space existing between the tab and the top surface of the can. The second preferred embodiment is particularly adapted for this task via its inclined, horse-shoe shaped bottom wall which, being sloped, aligns itself against the handle of the tab and effectively occupies the small spatial zone existing between the top surface of the can and the handle of the punch-key tab. The inverted cap covering can then be used to pivot and lift the tab, safely and easily, to breech or punch out the prepared flap seal in the can top along a predefined scored boundary, and thereby open the beverage can. This positioning and maneuver is illustrated by FIG. 7.

The Closure Function

After the beverage can has been opened, the cap will serve admirably as a means of covering and uncovering the punched out breech or aperture in the top of the can. When used as a closure, the cap covering is turned right side up and again slid onto the handle of the tab. This act is illustrated by FIG. 8.

Figure 8:
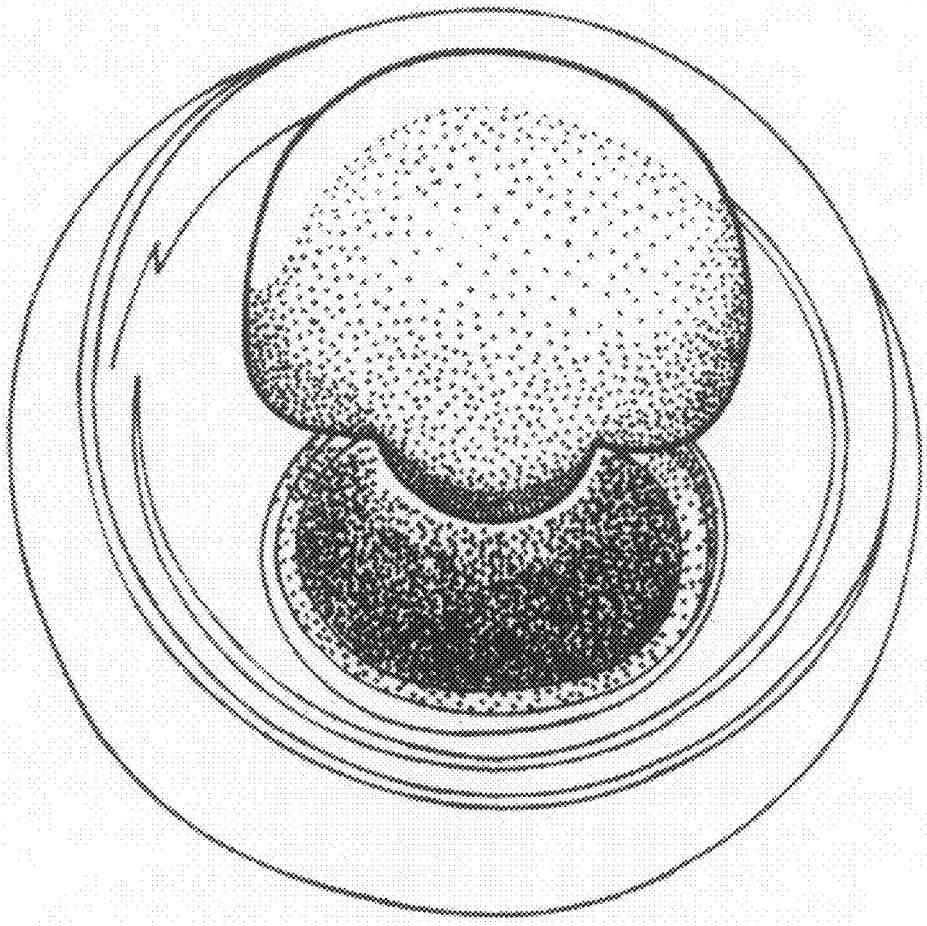
FIG. 8 is a photographic image showing the second preferred embodiment of the present invention positioned on the tab handle prior to rotation.

When placed in the rearward position seen in FIG. 8, the fitted cap covering encompassing and enclosing the handle of the tab is positioned in distance far enough away from the opening in the can to allow an uninterrupted flow of beverage; and the cap covering will not to interfere with the consumer's lips as he drinks from the can. The handle of the tab points in a slightly upward direction at the pivoting angle and is spatially clear from any contact with the can top surface.

Figure 9:
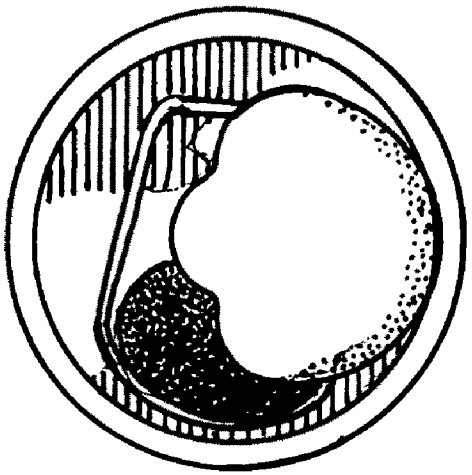
FIG. 9 is a photographic image showing the second preferred embodiment of the present invention positioned on the tab handle after partial rotation.

After the person has finished drinking from the can, (but has not consumed all of the beverage in the can), the cap covering is used as a closure. The tab handle and its fitted cap covering are together then rotated 180 degrees around the center rivet or pivot pin using one finger of the hand until both the tab handle and its fitted cap covering come to rest over the opening in the top of the beverage can. This act of rotation is illustrated by FIGS. 9 and 10 respectively.

Figure 10:
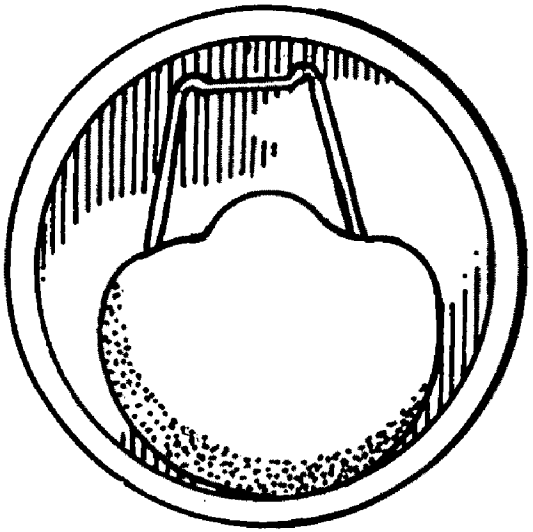
FIG. 10 is a photographic image showing the second preferred embodiment of the present invention positioned on the tab handle after 180 degrees of rotation.

The forward closure position shown by FIG. 10 can be maintained indefinitely, or until such time as the person is again thirsty. To reopen and again have access to the beverage then remaining in the can, all the person need do is continue to rotate the tab handle and its fitted cap covering another 180 degrees until the rearward position illustrated by FIG. 8 is again achieved.

Any person may then repeatedly and cyclically close and reopen the aperture and have access to the beverage remaining in the can. Repetitious open and close operations using the invention can be easily accomplished with a thumb push to open the can and an index finger to close the can.

IV. Advantages and Benefits Offered by the Invention

A number of desirable advantages and unexpected benefits are provided by the cap covering of the present invention. Among them are the following:

1. The cap covering will help to keep the carbonation (if any) in the beverage and help to maintain the beverage at the desired drinking temperature.

2. The cap covering will distinguish individual ownership among identical cans of beverage.

3. The invention helps to minimize spillage; will keep bugs and debris out; and keep the beverage in an unadulterated state.

4. The cap covering fits over the tab handle of the container and actually covers the sharp edges of the metallic substance or other material constituting the tab. The invention thus protects the fingers of the human hand from lacerations or pain which may be caused by applying the pressure needed to pivot the punch-key tab and open the container.

5. The cap covering protects the lips from coming into accidental contact with the handle of the tab, thereby protecting the lips from laceration or pain.

6. The cap covering is easily installed and quickly removed at will. The invention is neither cumbersome to use, nor difficult to apply.

7. The invention can be easily transported and even carried in one's pocket, owing to its' ergonomic and rounded design features.

8. Manufacturing of the cap covering is facilitated by its simple design.

9. Packaging and retailing of the cap covering is facilitated by the design, which is typically soft and rounded—unlike devices previously known in the prior art.

10. The cap covering may be easily cleaned for repeated usage.

The present invention is not to be restricted in form nor limited in scope except by the claims appended hereto.

What I claim is:

1. A cap covering for a punch-key tab rotably attached to the top of a preformed can having a rim, wherein the punch-key tab is to be pivoted by a person to punch out a prepared flap seal in the can top along a predefined scored boundary and a limited spatial zone then exists between the rotable handle of a pivoted punch-key tab and the top surface of the can, said cap covering comprising:

an attachable and detachable hollow casing which can be fitted on-demand onto the handle of a punch-key tab then rotably attached to the top of a preformed can and which may be rotated at will in combination with the handle of a punch-key tab, said hollow casing having (i) limited dimensions such that the fitted hollow casing rotably attached to the punch-key tab of a preformed can does not come into contact with the rim of the can, (ii) a substantially disc-shaped configuration, (iii) a shaped top wall of solid matter which is planar, is substantially uniform in thickness and has fixed dimensions and configuration, (iv) at least one shaped side wall of fixed dimensions and configuration, (v) a shaped bottom wall which has fixed dimensions and configuration, is a beveled sheet of solid matter, has an overall thickness which is graduated, has an exterior surface with an incline which increases markedly from its forward edge to its reward edge, and is substantively sufficient to occupy and fill the limited spatial zone which exists between the pivoted handle of a punch-key tab and the top surface of the can, and (vi) an empty internal cavity of preset spatial volume sized to accept and hold the handle of a punch-key tab rotably attached to the top surface of the can, whereby said hollow casing forms a unified article having a profile of recognizable configuration and has a shaped opening sized to accommodate entry and passage of the handle of a punch-key tab, and wherein the fixed dimensions of said hollow casing, when rotably attached to the handle of a punch-key tab, are substantively sufficient to occupy and fill the limited spatial zone then existing between the rotable handle of a pivoted punch-key tab and the top surface of the can and thereby serve as an on-demand closure for a punched-out flap seal in the can top.

2. A cap covering for a punch-key tab rotably attached to the top of a preformed can having a rim, wherein the punch-key tab is to be pivoted by a person to punch out a prepared flap seal in the can top along a predefined scored boundary and a limited spatial zone then exists between the rotable handle of a pivoted punch-key tab and the top surface of the can, said cap covering comprising:

an attachable and detachable hollow casing which can be fitted on-demand onto the handle of a punch-key tab then rotably attached to the top of a preformed can and which may be rotated at will in combination with the handle of a punch-key tab, said hollow casing having (i) limited dimensions such that the fitted hollow casing rotably attached to the punch-key tab of a preformed can does not come into contact with the rim of the can, (ii) a substantially disc-shaped configuration, (iii) a shaped top wall of solid matter which is planar, is substantially uniform in thickness and has fixed dimensions and configuration, (iv) at least one shaped side wall of fixed dimensions and configuration, (v) a shaped partially open bottom wall which has fixed dimensions and configuration, is a beveled partially open sheet of solid matter, has an overall thickness which is graduated, has an exterior surface with an incline which increases markedly from its forward edge to its reward edge, and is substantively sufficient to occupy and fill the limited spatial zone which exists between the pivoted handle of a punch-key tab and the top surface of the can, and (vi) an empty internal cavity of preset spatial volume sized to accept and hold the handle of a punch-key tab rotably attached to the top surface of the can, whereby said hollow casing forms a unified article having a profile of recognizable configuration and has a shaped opening sized to accommodate entry and passage of the handle of a punch-key tab, and wherein the fixed dimensions of said hollow casing, when rotably attached to the handle of a punch-key tab, are substantively sufficient to occupy and fill the limited spatial zone then existing between the rotable handle of a pivoted punch-key tab and the top surface of the can and thereby serve as an on-demand closure for a punched-out flap seal in the can top.

3. The cap covering for a punch-key tab as recited by claim 1 or 2 wherein the configuration of said hollow casing is one selected from the group consisting of rounded shapes, oval shapes, balloon shapes.

4. The cap covering for a punch-key tab as recited by claim 1 or 2 wherein the configuration of said hollow casing is one selected from the group consisting of regular and irregular forms, symmetrical and asymmetrical forms, and geometric and non-geometric forms.

5. The cap covering for a punch-key tab as recited by claim 1 or 2 wherein said hollow casing includes two transverse solid walls aligned in parallel and one solid sidewall joined to said transverse walls.

6. The cap covering for a punch-key tab as recited by claim 2 wherein said hollow casing includes a first solid wall, a second partially open solid wall aligned in parallel with said first solid wall, and one solid sidewall joined to said first and second walls.

7. The cap covering for a punch-key tab as recited by claim 1 or 2 wherein said hollow casing is formed using at least one elastomeric substance.

* * * * *